United States Patent [19]

Rothchild

[11] 4,237,700

[45] Dec. 9, 1980

[54] METHODS AND APPARATUS FOR PROVIDING REFRIGERATION

[75] Inventor: Ronald D. Rothchild, South Orange, N.J.

[73] Assignee: Airco, Inc., Montvale, N.J.

[21] Appl. No.: 31,718

[22] Filed: Apr. 20, 1979

[51] Int. Cl.[3] ..... F17C 7/02

[52] U.S. Cl. ..... 62/514 R

[58] Field of Search ..... 62/54, 514 R, 50, 51, 62/52, 53

[56] References Cited

U.S. PATENT DOCUMENTS

| | | | |
|---|---|---|---|
| 3,058,317 | 10/1962 | Putman | 62/52 |
| 3,937,031 | 2/1976 | Cook | 62/514 R |
| 4,110,996 | 9/1978 | Thompson | 62/54 |
| 4,116,017 | 9/1978 | Oberpriller | 62/62 |
| 4,122,684 | 10/1978 | Clarkson et al. | 62/54 |
| 4,133,663 | 1/1979 | Skinner | 62/23 |

*Primary Examiner*—Ronald C. Capossela

*Attorney, Agent, or Firm*—David L. Rae; Larry R. Cassett; Edmund W. Bopp

[57] ABSTRACT

The refrigeration available in a liquefied gas is utilized to refrigerate a fluid having a boiling point above the boiling point of the liquefied gas which is sprayed into an endless conduit such that the liquefied gas is vaporized. The resulting thermal currents and momentum of the spray are effective to provide the motive power for circulating the gas throughout the conduit and into indirect heat exchange with the fluid to be refrigerated. The temperature of heat exchange means in the vicinity of the location at which the fluid is introduced into such indirect heat exchange may be regulated by controlling the magnitude of the gas flow throughout the conduit to thereby avoid freezing of components of such fluid. The use of shaft power (such as a fan or blower) for circulating the gas flow throughout the conduit is avoided and the utilization of refrigeration available in the liquefied gas is improved accordingly.

20 Claims, 2 Drawing Figures

METHODS AND APPARATUS FOR PROVIDING REFRIGERATION

BACKGROUND OF THE INVENTION

The present invention relates to methods and apparatus for refrigerating fluids and more particularly, to methods and apparatus for efficiently utilizing the refrigeration available in a liquefied gas.

The refrigeration available from liquefied gases such as liquid nitrogen, liquid argon, etc. is commonly utilized due to the relatively low or cryogenic temperatures at which such liquefied gases are normally produced. For example, it is known to utilize such refrigeration in the condensation of of vapors recovered from a particular process as is illustrated in U.S. Pat. Nos. 4,133,663 and 4,150,494 the latter being assignedto the assignee of the present invention. Typically, the liquefied gas is passed through a multipass indirect heat exchange device in counterflow to the vapors being condensed thereby yielding its refrigeration to and condensing such vapors. It is recognized, however, that due to the intense cold available from such liquefied gases (which typically exist at about −280° F. to −320° F.), steps must be taken to assure that undesirable freezing of fluids which are to be refrigerated is avoided. One such technique for reducing the adverse effects of the intense cold available from liquefied gases is illustrated in U.S. Pat. No. 4,188,793 wherein liquid nitrogen is sprayed (FIG. 4) into a chamber to vaporize the same and form a cold gas which is then utilized to condense a particular volatile vapor. Such condensation results in a warming of the cold gas which is returned by a fan or blower into direct contact with the spray of liquid nitrogen thereby facilitating further vaporization thereof. The rate at which liquid nitrogen is sprayed into contact with the returned gas is controlled by sensing the temperature of such gas and in this manner, the intense refrigeration available from liquid nitrogen may be limited to avoid freezing of condensed vapors. It is noted, however, that blowers which consume shaft power and hence introduce heat into the refrigeration system are required to circulate gas throughout the system thereby reducing the efficiency of refrigerant nitrogen and increasing operating costs. Furthermore, although the temperature of the cold gas utilized to condense vapors is sensed, there are no apparent means utilized to limit heat exchange between such cold gas and the fluid to be condensed and consequently, moisture which may be carried by such fluid may be frozen upon initial heat exchange with the cold gas.

A further technique for utilizing the refrigeration available from a liquefied gas to refrigerate a fluid such as by condensing a vapor is illustrated in U.S. Pat. No. 4,122,684. In the apparatus illustrated in this reference, an intermediate refrigerant such as methane is utilized as a heat transfer medium between the liquefied gas and the particular fluid to be refrigerated. Although freezing of such fluid may be avoided, the use of a separate, intermediate refrigerant requires rather complex apparatus in addition to the cost of providing a separate refrigerant itself and thus renders the overall economics of such vapor condensation questionable.

Accordingly, the prior art evidences a clear need for methods and apparatus for utilizing the refrigeration available in liquefied gas to refrigerate fluids without freezing the same or components thereof while efficiently utilizing the refrigeration available from such liquefied gases.

OBJECTS OF THE INVENTION

It is an object of the present invention to provide improved methods and apparatus for utilizing refrigeration available from liquefied gases.

It is a further object of the present invention to provide improved methods and apparatus for efficiently utilizing refrigeration available from liquefied gases to condense vapors of higher boiling point fluids without freezing such condensed vapors.

It is a further object of the present invention to provide methods and apparatus for condensing vapors by indirect heat exchange with a gaseous refrigerant without requiring the use of shaft power for circulating such refrigerant throughout a heat exchange system.

It is still another object of the present invention to provide improved methods and apparatus for condensing vapors of a fluid in a heat exchange device wherein the local heat exchange surface temperatures to which such vapors are initially exposed are maintained at controlled values to avoid application of excessive refrigeration to such vapors.

Other objects of the present invention will become apparent from the following descriptin of exemplary embodiments thereof which follows, and the novel features will be particularly pointed out in conjunction with the claims appended hereto.

SUMMARY

In accordance with the invention, a method of utilizing refrigeration available from a liquefied gas to refrigerate a fluid having a boiling point above the boiling point of the liquefied gas comprises introducing liquefied gas into an endless conduit to vaporize the same and form a gas therein with thermal currents and the momentum provided by said spray supplying the motive power for circulating said gas throughout said conduit, passing said fluid in indirect heat exchange with said gas in said conduit to refrigerate said fluid and heat said gas, and returning the heated gas into direct contact with said spray to promote vaporization of said liquefied gas. The conduit is provided with first and second vertical legs into which said liquefied gas is introduced and said fluid is passed in heat exchange with said gas, respectively.

By introducing a spray of liquefied gas into the conduit, effective gas-liquid contact may be achieved thereby vaporizing the liquefied gas and cooling gas contacted by the spray to establish a downward thermal current in the conduit in the vicinity of the spray. By disposing the spray in a downward direction in the conduit, the momentum of the sprayed liquefied gas will be fully imparted to the gas and thus augment the thermal downdraft and promote circulation of a cold gas flow through the conduit. As the cold gas flows upwardly in another leg of the conduit in indirect heat exchange relation with a fluid being refrigerated, the gas is heated to develop an upward thermal current (gradient) thereby assisting in circulating gas through the conduit. The spray is preferably disposed to avoid creating local areas of intense cold in the conduit and by use of such a spray, shaft power as commonly provided by a fan or blower for circulating gas throughout the conduit is avoided. As shaft power generates heat, the ability to dispense with fans, blowers, etc. reduces the refigeration load imposed upon the gas flow and consequently, enables more efficient and economical use of the liquefied gas refrigerant. Thus, less liquefied gas is utilized to effect a given degree of refrigeration and the liquefied gas will only be required to balance heat added to the conduit by the fluid being refrigerated. Also, by utilizing a conduit having a relatively large cross-sectional area, low pressure drops and less motive power will be required to provide a given flow. Also, less heat will be developed by friction between the gas flow and conduit walls due to relatively low gas velocities.

The fluid which is refrigerated may be a gas which is condensed to a liquid state or simply a liquid which is chilled by sensing the temperature of the refrigerated fluid, the magnitude of the sprayed liquefied gas flow may be controlled so as to maintain the refrigerated fluid at a predetermined temperature. Preferably, heat exchange surfaces of the location where the fluid to be refrigerated is introduced into direct heat exchange with the gas flow are maintained at appropriate temperatures so that the fluid itself and potential components thereof, such as moisture, can be kept from freezing. Such temperatures are maintained by controlling the magnitude of the conduit gas flow in response to temperatures sensed at such heat exchange surface locations. The temperature of the refrigerated fluid will be controlled independently of the temperature of such heat exchange surface locations. Thus, not only is refrigeration utilized efficiently in the process according to the inventin but the refrigeration available from a liquefied gas is controlled so as not to impede flows of a fluid being refrigerated by freezing components thereof.

BRIEF DESCRIPTION OF THE DRAWING

The invention will be more clearly understood by reference to the following description of exemplary embodiments thereof in conjunction with the following drawing in which.

DESCRIPTION OF PREFERRED EMBODIMENT

Figure 1:
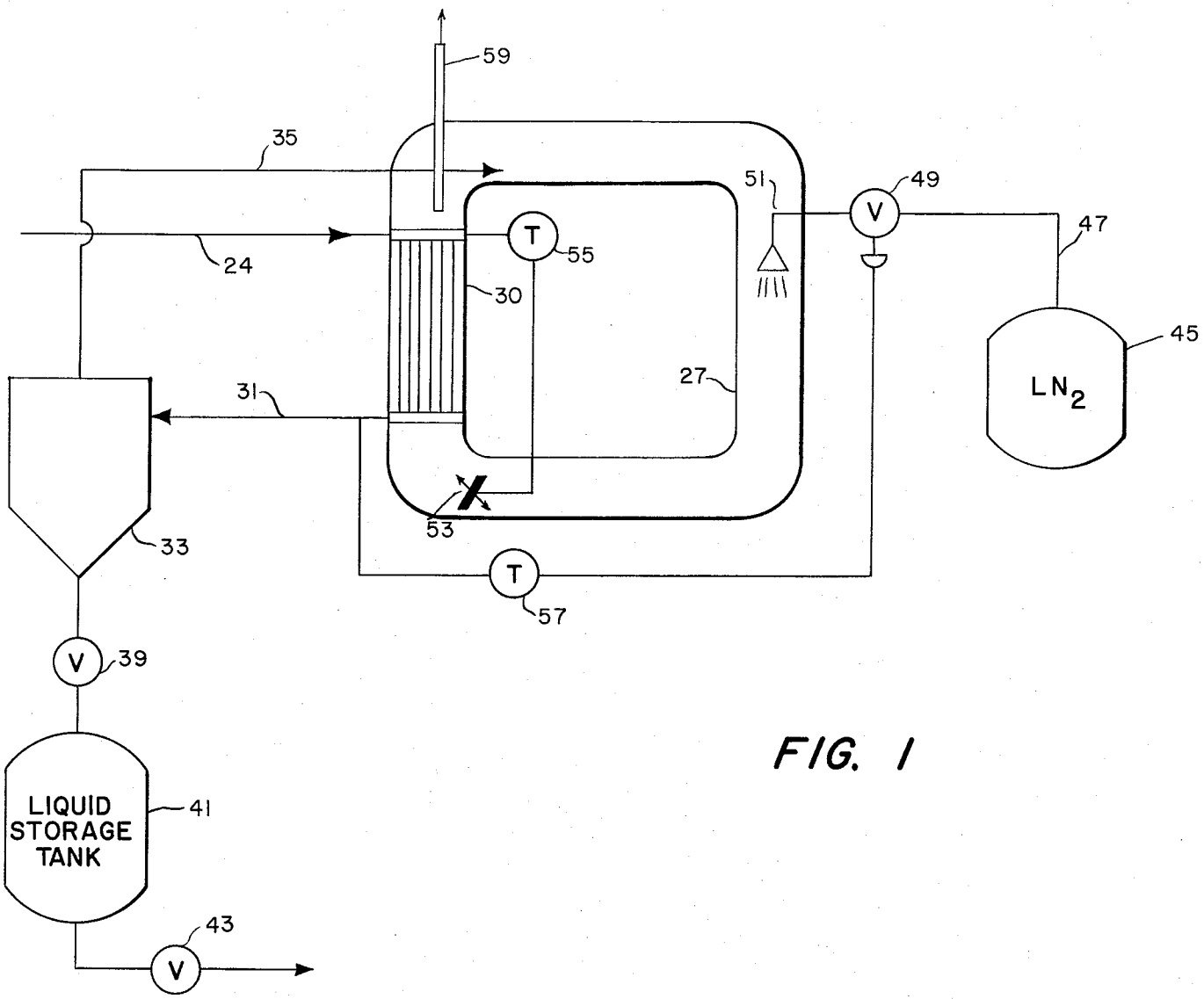
FIG. 1 is a diagrammatic view of apparatus for condensing a vapor in accordance with the present invention.

In order to facilitate a full understanding of the present invention, the apparatus and operation thereof illustrated in FIGS. 1 and 2 will be described in relation to the condensation of solvent vapor recovered from a process such as a method for curing solvent borne resin coatings on a particular material. However, the method and apparatus for refrigerating fluid in accordance with the invention may be applied to the condensation of other vapors and/or chilling of liquids. The boiling point of the fluid being refrigerated must be above the boiling point of the liquefied gas being utilized in order for refrigeration of the fluid to be achieved effectively. Referring now to FIG. 1 illustrated therein is an exemplary embodiment of apparatus for refrigerating a fluid which may comprise a solvent vapor supplied together with nitrogen gas through conduit 24 from the exhaust of an oven (not shown) to the warm end of heat exchange means 30.

Heat exchange means 30 may comprise any suitable indirect heat exchange apparatus such as a shell and tube heat exchange device which is disposed within conduit 27, the latter being an essentially endless continuous conduit adapted to pass a gas flow therethrough. Preferably, conduit 27 will assume a "doughnut" configuration having essentially vertical 'legs' or the like in which a spray device 51 and heat exchange means 30 are disposed. The cross-sectional area of conduit 27 will be such that relatively low pressure drops, i.e. up to 1.0 psi, will occur therein and gas will be circulated without use of a fan or blower at velocities up to about 30 ft/sec. The lower or cold end of heat exchange means 30 is connected through conduit 31 to phase separator 33. The non-condensed gas (essentially nitrogen) also supplied through conduit 31 may be returned from separator 33 through conduit 35 to conduit 27. It will be appreciated that such non-condensed gas will be returned to conduit 27 when this gas is at a temperature below the temperature of the warm end of heat exchange means 30 to add refrigeration to the gas being returned into contact with spray device 51. Should the temperature of the gas in conduit 35 exceed the temperature at the warm end of heat exchange means 30, such uncondensed gas may be passed together with gas in conduit 59 to other uses. Preferably, conduit 35 is disposed to emit uncondensed gas into conduit 27 in a direction co-current with the gas flow therein to increase the motive force acting on gas flowing in conduit 27. A vent line 59 is placed in communication with conduit 27 and is adapted to pass a portion of the gas flow therein to a particular process in which such gas may be utilized, i.e. a process for curing solvent borne resin coatings is as disclosed in U.S. Pat. No. 4,150,494. Disposed in one leg of conduit 27 is a spray device 51 which is adapted to receive a controlled flow of liquefied gas such as liquid nitrogen from source 45 through line 47 and valve 49. Spray device 51 is disposed so as to direct a spray of liquefied gas downwardly in conduit 27 (without substantially contacting interior wall surfaces) thereby vaporizing the liquefied gas and imparting the momentum of the liquid spray to gas in conduit 27. The vaporization of liquefied gas (e.g. $LN_2$ at a temperature of −320° F.) results in a 'cold' gas in the vicinity of spray device 51 and a thermal gradient is produced. This thermal gradient generates thermal downdrafts or currents wihich together with momentum imparted by the spray of liquefied gas induce a gas flow downwardly in conduit 27 without use of a fan or blower. The gas flow rising through heat exchange means 30 is returned through the upper portion of conduit 27 to spray device 51 and as such returned gas is relatively warm compared with the temperature of sprayed liquefied gas, vaporization thereof is promoted.

A damper 53 or other suitable flow control device is disposed in conduit 27 and is effective to control the magnitude of the gas flow therein. A temperature sensing device 55 is adapted to detect the temperature of surfaces of heat exchange means 30 at a location where the fluid to be refrigerated initially contacts such heat exchange surfaces and is effective to control the position of damper 53 as will be described in greater detail hereinafter. It will be understood that liquefied gas in introduced through spray 51 into conduit 27 in addition to gas supplied thereto through conduit 35 and an amount of gas equal to the total gas added to conduit 27 is vented therefrom (or used for other purposes) through line 59 to establish a mass balance with respect to conduit 27. However, the rate at which gas is circulated through conduit 27, e.g. the gas flow rate, is controlled by controlling the position of damper 53 which control is essentially independent of the aforementioned mass balance. The rate at which liquefied gas is introduced into conduit 27 may be regulated (independently of damper 53) by detecting the temperature of the refrigerated fluid in conduit 31 by means of temperature sensor 57 and controlling the opening of valve 49 accordingly. The liquid collected in separator 33 is passed through valve 39 to a liquid storage tank 41 which may be drained through valve 43 or the like. In the event that the fluid being refrigerated is a solvent vapor recovered from a curing oven as mentioned above, the resulting condensed liquid solvent may be utilized again in forming coatings to be cured.

In the operation of apparatus illustrated in FIG. 1, a fluid to be refrigerated is supplied through line 24 (after previous chilling and/or condensing steps as may be necessary) to the warm end of indirect heat exchange means 30. A flow of liquefied gas (having a boiling point below the boiling point of the fluid) is supplied from source 45 through line 47 and valve 49 to spray device 51 which is disposed in conduit 27 and is effective to emit a fine liquid spray preferably in a downward direction. The liquefied gas is thus vaporized in conduit 27 and upon its absorption of the heat of vaporization, a cooling effect on the gas in conduit 27 occurs in the vicinity of spray device 51. This cooling effect generates a thermal gradient and a downward flowing thermal gas current is created. The momentum of liquefied gas sprayed into conduit 27 is imparted to gas in the vicinity of spray device 51 and augments the motive power induced by the aforementioned thermal draft to circulate cold gas toward heat exchange means 30. Thus, motive power for circulating gas through conduit 27 is provided without fans or blowers. Preferably, conduit 27 is of sufficient cross-section area so that gas flows therein are subjected to relatively low drops, for example less than 1.0 psi. Spray device 51 is also effective to emit liquefied gas in such manner that areas or locations of intense cold are avoided and preferably no liquefied gas contacts the interior walls of conduit 27 thereby avoiding inefficient utilization of the refrigeration available in a liquefied gas such as liquid nitrogen.

The fluid to be refrigerated is passed through line 24 into the tube side of heat exchange means 30 while the gas flow in conduit 27 which may exhibit a temperature of −100° F. at the lower end of heat exchange means 30 passes upwardly through the shell side thereof. As the gas flow is warmed upon the aforementioned indirect heat exchange with the fluid being refrigerated, a thermal gradient is established as the top end of heat exchanger means 30 is warmer than the lower end. Thus, a thermal draft in an upward direction will be induced through heat exchange means 30 and this updraft cooperates with the downdraft at spray device 51 to thereby facilitate a flow of gas throughout conduit 27. Thus, the thermal drafts induced in the vicinity of spray device 51 and heat exchange means 30 work in concert with one another and with momentum imparted by the spray of liquefied gas to enable circulation of a gas flow throughout conduit 27. The use of shaft power such as a motor driven fan or blower is rendered unnecessary and is avoided by the ability of low pressure, low velocity (1-30 ft/sec) gas to circulate throughout conduit 27 due to the relatively low pressure drops therein. The induced gas flow generated by the thermal drafts and momentum imparted by the spray of liquefied gas provide essentially all of the motive power necessary to circulate gas through conduit 27. Thus, by avoiding the use of shaft power to circulate gas through conduit 27, the quantity of liquefied gas required to achieve a desired degree of refrigeration of fluid in conduit 24 is minimized as the need to compensate for heat generated by shaft power is obviated. Also, by sizing conduit 27 so that only low pressure drops occur, the heat generated by friction between such flows and conduit walls is also minimized and thus, the quantity of liquefied gas supplied to spray device 51 is essentially only the quantity necessary to balance heat removed from the fluid being refrigerated in heat exchange device 30 so that efficient refrigeration of such fluid is effected.

In certain instances, the fluid supplied through line 24 to the warm end of heat exchange means 30 will contain relatively high freezing point materials such as moisture and it is therefore necessary to control the temperature of gas at this location so that moisture in a given fluid will not freeze upon introduction into heat exchange means 30. Accordingly, by sensing the temperature of the surfaces of heat exchange means 30 (typically tube surfaces) and controlling the position of damper 53 in response thereto, the magnitude of the gas flow supplied to heat exchange means 30 may be controlled and consequently the refrigeration supplied to this heat exchange means is thereby regulated. Typically, it may be desired to maintain a temperature of at least 32° F. at the warm end of heat exchange means 30. Although the temperature of the fluid being refrigerated is commonly reduced to temperatures as low as −20° F. or lower, at which temperatures moisture alone would certainly freeze, it has been found that by condensation of certain fluid vapors such as alcohol or acetone, moisture will dissolve in the condensed vapor and will not collect on the internal surface of tubes of heat exchange means 30 but will be carried therethrough with the condensed vapor.

The temperature of the refrigerated fluid in line 31 may be utilized to establish predetermined temperatures in conduit 27, i.e. the temperature in conduit 27 at the cold or lower end of heat exchange means 30 independently of the temperature maintained at heat exchange surfaces to which fluid in conduit 24 is initially exposed. Typically, such a cold end temperature may be −100° F. and should the temperature of refrigerated fluid in line 31 decrease below a predetermined level, the reduced temperature will be sensed by temperature sensing device 57 which in turn is effective to operate control valve 49 so as to assume a more closed position thereby reducing the flow of liquefied gas to spray device 51 and consequently, raising the gas temperature at the low or cold end of heat exchange means 30. Consequently, not only does the method and apparatus according to the present invention enable the efficient refrigeration of a fluid by indirect heat exchange with a cold gas but the extent to which such fluid may be refrigerated may be accurately controlled and the freezing of components of such fluid or the fluid itself may also be precluded.

In addition to condensing a gas by providing refrigeration in accordance with the apparatus illustrated in FIG. 1, the invention may be applied in a manner so as the chill a liquid fluid which in turn may be utilized to condense a gas phase thereof or another gas having a higher boiling point. Referring now to FIG. 2 illustrated therein is such a latter system in which a fluid such as a gaseous mixture of solvent vapor and nitrogen gas recovered from a curing oven is supplied through line 60 to scrubber 62. A liquid, which may comprise liquid solvent, is collected in the bottom of scrubber 62 and is pumped through line 70 by pump 72 through line 73 to indirect heat exchange means 30. As previously described in connection with the apparatus illustrated in FIG. 1, a liquefied gas such as liquid nitrogen in storage means 45 is passed through valve 49 to spray device 51 which is effective to emit a fine spray of liquefied gas downwardly in conduit 27. The resulting cold gas flow developed upon vaporization of such liquefied gas is propelled by thermal currents and spray momentum into indirect heat exchange with the liquid supplied through line 73 to heat exchange means 30. Outlet line 31 is effective to pass chilled liquid from heat exchange means 30 to a spray device 68 disposed in scrubber 62 to condense one component, i.e. solvent, remaining in the gaseous fluid supplied thereto through line 60. Preferably, scrubber 62 is supplied with a suitable demisting device 65 and non-condensed vapor, which is essentially comprised of another component, i.e. nitrogen, is vented through valve 66 or utilized for other purposes as may be desired. The condensed component will collect as a liquid in the bottom portion of scrubber 62 and upon reaching a desired level is removed through line 64 and is passed to storage tank 41.

The lowest temperature which will be established in conduit 27 may be controlled by sensing temperature of the liquid fluid in line 31 by means of temperature sensing device 57 and by controlling the opening of control valve 49 in response to such sensed temperature to control the flow of liquid nitrogen to spray device 51. Thus, the system depicted in FIG. 2 is effective to enable control over the lowest temperature established on conduit 27 and the degree to which refrigeration is supplied to a fluid being chilled in heat exchange means 30.

Figure 2:
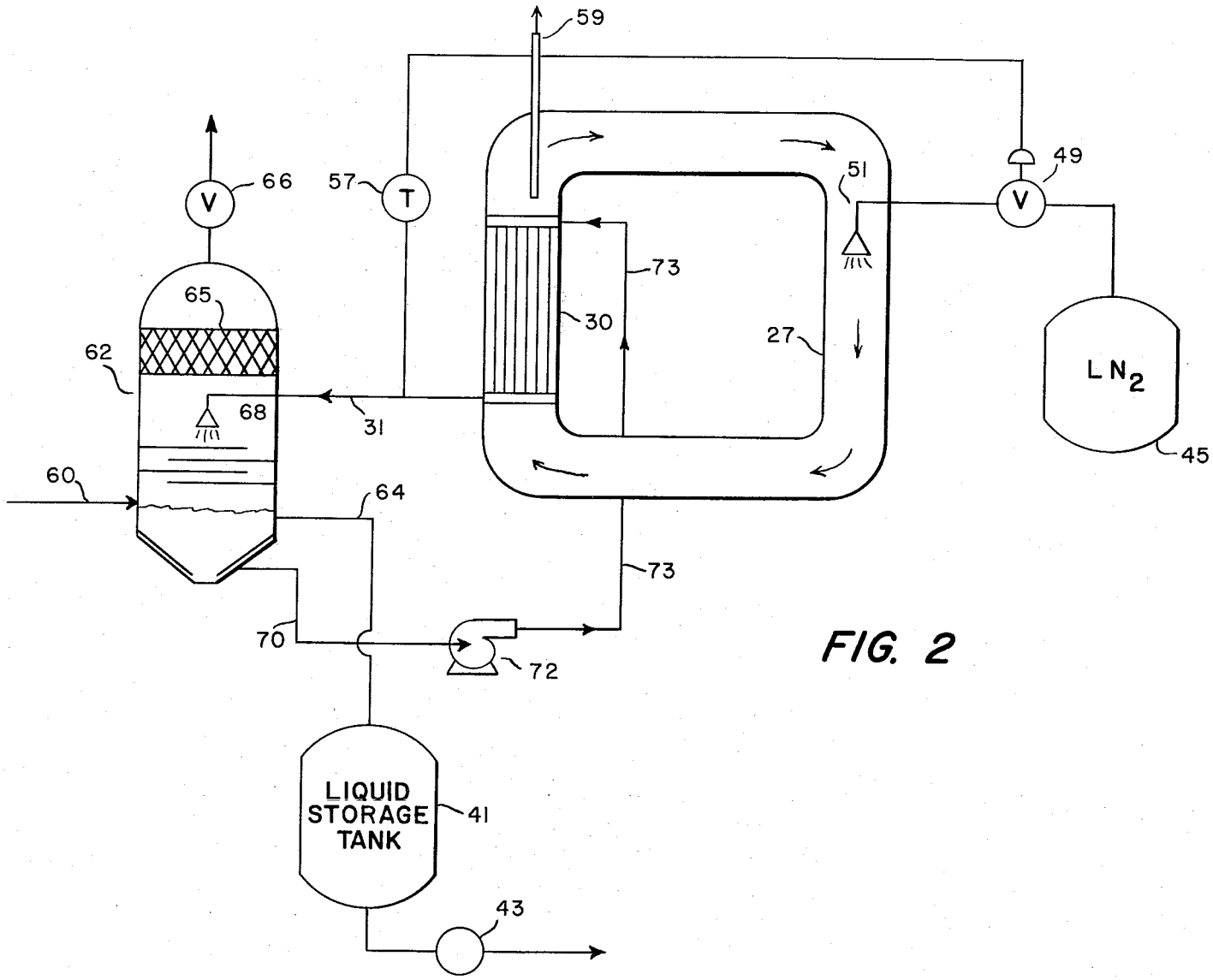
FIG. 2 is a further diagrammatic view of apparatus including a scrubber device for condensing a vapor in accordance with the invention.

It will be understood that the apparatus illustrated in FIG. 2 will not require the use of a damper 53 (FIG. 1) as the fluid supplied to heat exchange means 30 to be refrigerated is in liquid form. Thus, moisture will tend to be dissolved in such liquid and, in general, it will not be necessary to maintain the temperature of the top end of heat exchange means 30 (FIG. 2) above 32° F. However, damper 53 may be used if it is desirable, for any reason, to maintain a high, and controllable, temperature gradient along heat exchange means 30.

Although the gas flow indicated by arrows in FIGS. 1 and 2 is in a clockwise direction, such flow may be counterclockwise. It is important, however, that spray 51 and heat exchange means 30 are in different legs of, or are otherwise disposed in conduit 27 such that thermal down and up drafts, respectively, and momentum imparted by spray 51 act in concert to circulate a gas flow through conduit 27 as it is such cooperative action which enables the use of shaft power to be averted. In general, the thermal drafts in conduit 27 will provide a significant portion of the motive power for circulating gas and may be utilized without the momentum provided by a spray of liquefied gas by device 51. Thus, device 51 may be disposed in a position other than downwardly in conduit 27 although the latter orientation of device 51 will produce the greatest effect in increasing motive power.

Although the fluid to be refrigerated by apparatus in accordance with the present invention has been described as the liquid and gaseous phases of a solvent emitted from a curing process, it will be understood that such apparatus and operation thereof may be utilized to refrigerate any fluid having a boiling point above the boiling point of the particular liquefied gas. Furthermore, although simple two-pass and shell and tube type heat exchange devices have been illustrated, it will be apparent to those skilled in the art that other suitable heat exchange means may be utilized as well.

The foregoing and other various changes in form and details may be made without departing from the spirit and scope of the present invention. Consequently, it is intended that the appended claims be interpreted as including all such changes and modifications.

I claim:

1. A method of utilizing the refrigeration available in a liquefied gas to refrigerate a fluid having a boiling point above the boiling point of the liquefied gas comprising the steps of: introducing said liquefied gas into an endless conduit to vaporize said liquefied gas and including a thermal downdraft to provide motive power for circulating a flow of said gas through said conduit; passing said fluid in indirect heat exchange relation with said gas flow in said conduit to refrigerate said fluid and heat said gas flow while inducing a thermal updraft of said gas flow; and returning a portion of said heated gas into direct contact with said spray of liquefied gas to augment the vaporization thereof with said thermal drafts providing motive power for circulating said gas flow through said conduit without the use of shaft power.

2. The method defined in claim 1 additionally comprising the step of controlling the magnitude of said gas flow by sensing the temperature of said heat exchange means at a location at which said fluid is initially introduced into heat exchange relation with said gas flow and regulating said gas flow in response to said sensed temperatue.

3. The method defined in claim 2 whrein said step of regulating said gas flow comprises adjusting the position of a damper in said conduit in response to said sensed temperature.

4. The method defined in claim 3 wherein said damper (i) is adjusted to a more open position upon said sensed temperature being above said predetermined minimum temperature and (ii) is adjusted to a more closed position upon said sensed temerature being below said predetermined minimum temperature.

5. The method defined in claim 1 further comprising the step of sensing the temperature of the refrigerated fluid and controlling the rate at which said liquefied gas is sprayed into said conduit in response to said sensed temperature.

6. The method defined in claim 5 wherein the cross sectional area of said conduit is such that the pressure drop of gas circulated throughout said conduit is up to approximately 1.0 psi or less.

7. The method defined in claim 1 wherein said fluid is comprised of a mixture of nitrogen gas and vapor having a boiling point above the boiling point of nitrogen and said liquefied gas is comprised of liquid nitrogen, with the step of passing said fluid in indirect heat exchange with said gas flow comprising condensing said vapor.

8. The method defined in claim 7 further comprising the steps of separating said condensed vapor from uncondensed nitrogen gas, recovering said separated condensed vapor in a storage vessel and returning said separated nitrogen gas to said conduit.

9. The method defined in claim 1 wherein said liquefied gas is liquid nitrogen and said fluid is a liquid having a boiling point above the boiling point of liquid nitrogen and further comprising the steps of supplying a mixture comprised of the vapor phase of said liquid and nitrogen gas to a scrubber and introducing the refrigerated liquid into said scrubber and into direct contact with said mixture to condense said vapor phase.

10. The method defined in claim 9 further comprising the steps of recovering condensed vapor from said scrubber and supplying at least a portion of said recovered condensed vapor as said liquid in indirect heat exchange with said gas flow in said conduit.

11. The method defined in claim 1 wherein the steps of introducing said liquefied gas comprises spraying said liquefied gas downwardly into said conduit.

12. A method of condensing vapor by use of the refrigeration available in a liquefied gas having a boiling point lower than the boiling point of said vapor in a conduit having first and second legs connected to define an endless flow path comprising the steps of:

spraying said liquefied gas downwardly into said first leg to vaporize the same thereby forming a cold gas therein while imparting momentum to said gas and inducing a thermal downdraft in said first leg to provide motive power for circulating gas through said conduit toward said second leg;

passing said cold gas upwardly through said second leg in indirect heat exchange with said vapor to condense said vapor and heat said cold gas and induce a thermal updraft in said second leg; and returning a portion of said heated gas to said first leg in direct heat exchange relation with said spray of liquefied gas with said thermal drafts and momentum supplying substantially all of the motive power for circulating said gas throughout said conduit.

13. A method of chilling a liquid by indirect heat exchange with a vaporized liquefied gas having a boiling point lower than the boiling point of the liquid in a conduit having first and second legs connected to define and endless flow path comprising the steps of:

spraying said liquefied gas downwardly into said first leg to vaporize the same thereby forming a cold gas therein while imparting momentum to said gas and inducing a thermal downdraft in said first leg to provide motive power for circulating said cold gas through said conduit toward said second leg, passing said cold gas upwardly through said second leg in indirect heat exchange with said liquid to chill said liquid and heat said cold gas while inducing a thermal updraft in said second leg; and returning said heated gas to said first leg into direct heat exchange with said spray of liquefied gas with said momentum and thermal drafts supplying substantially all of the motive power for circulating said gas throughout said conduit.

14. Apparatus for utilizing the refrigeration available from a liquefied gas to refrigerate a fluid having a boiling point above the boiling point of said liquefied gas comprising an endless conduit having first and second legs disposed substantially vertically; means for spraying said liquefied gas into said first leg to vaporize the same to form a gas while imparting momentum to said gas and inducing a thermal downdraft to provide motive power required to circulate a flow of said gas to said second leg; means disposed in said second leg for passing said fluid in indirect heat exchange with said gas flow to refrigerate said fluid and heat said gas to induce a thermal updraft in said second leg; and means for returning a portion of heated gas to said first leg into direct heat exchange with said spray of liquefied gas with said thermal drafts and momentum being effective to circulate said gas flow throughout said conduit without the use of shaft power.

15. Apparatus defined in claim 14 additionally comprising means for sensing the temperature of surfaces of said heat exchange means at locations at which said fluid is introduced into indirect heat exchange with said gas; and means responsive to said sensed temperature for controlling the magnitude of said gas flow whereby said locations are maintained at temperatures above a predetermined value.

16. Apparatus as defined in claim 15 wherein said fluid comprises vapor which is condensed in said indirect heat exchange means and additionally comprising means connected to said heat exchange means for recovering said condensed vapor.

17. Apparatus as defined in claim 15 wherein said means for controlling said gas flow comprises adjustable damper means the position of which is altered in response to said sensed temperature.

18. Apparatus defined in claim 14 wherein said fluid being refrigerated is substantially completely liquid and additionally comprising scrubber means; means for supplying said refrigerated liquid to said scrubber means and means for supplying the gaseous phase of said fluid to said scrubber wherein said gaseous phase is condensed in said scrubber upon direct heat exchange with said refrigerated liquid.

19. Apparatus as defined in claim 18 further comprising means for removing liquid condensed in said scrubber therefrom; and means for returning a portion of said condensed liquid to said indirect heat exchange means as said fluid to be refrigerated.

20. Apparatus defined in claim 14 wherein said spray is disposed in said conduit in a downward direction.

* * * * *

UNITED STATES PATENT AND TRADEMARK OFFICE

CERTIFICATE OF CORRECTION

PATENT NO. : 4,237,700

DATED : December 9, 1980

INVENTOR(S) : RONALD D. ROTHCHILD

It is certified that error appears in the above-identified patent and that said Letters Patent are hereby corrected as shown below:

Column 1, line 16, the second "of" should be deleted.

Column 4, line 43, "wihich" should read --which--;
line 59, "hereinafter" should read --hereafter--.

Column 5, line 50, "changer" should read --change--.

Claim 1, line 16, "including" should read --inducing--.

Claim 2, line 33, "temperatue" should read --temperature--.

Claim 3, line 34, "whrein" should read --wherein--.

Claim 4, line 42, "temerature" should read --temperature--.

Claim 11, line 11, "steps" should read --step--.

Signed and Sealed this

*Seventh* Day of *April 1981*

[SEAL]

*Attest:*

RENE D. TEGTMEYER

*Attesting Officer* *Acting Commissioner of Patents and Trademarks*